US006113196A

United States Patent [19]

Kuo

[11] Patent Number: 6,113,196

[45] Date of Patent: Sep. 5, 2000

[54] DETACHABLE LUGGAGE WHEEL

[75] Inventor: Chung-Hsien Kuo, Pan-Chiao, Taiwan

[73] Assignee: Chaw Khong Technology Co., Ltd., Taipei County, Taiwan

[21] Appl. No.: 09/305,669

[22] Filed: May 5, 1999

[51] Int. Cl.[7] ..... B60B 19/00; A45C 5/14

[52] U.S. Cl. ..... 301/120; 301/125; 190/18 A

[58] Field of Search ..... 301/5.1, 111, 113, 301/120, 121, 124.1, 125, 126, 131; 190/18 A, 25, 37, 100; 280/37

[56] References Cited

U.S. PATENT DOCUMENTS

| | | | |
|---|---|---|---|
| 351,425 | 10/1886 | Coleman | 301/120 |
| 4,913,610 | 4/1990 | Olivieri | 301/120 X |
| 5,385,356 | 1/1995 | Conte | 301/120 X |
| 5,507,566 | 4/1996 | Chen | 301/121 X |
| 5,921,635 | 7/1999 | Deliman et al. | 301/132 X |

FOREIGN PATENT DOCUMENTS

| | | |
|---|---|---|
| 84203594 | 10/1995 | China . |
| 83209412 | 11/1995 | China . |

*Primary Examiner*—Russell D. Stormer
*Attorney, Agent, or Firm*—Dougherty & Troxell

[57] ABSTRACT

A detachable luggage wheel comprises a pedestal, and a wheel located on a lower part of the pedestal, a recessed portion provided on a side of the pedestal adjacent to a hub of the wheel, and a blocking member complementary in a shape to the recessed portion for being able to cling to a resilient locking member of the recessed portion for providing the fit setting of the blocking member onto the recessed portion, and preventing a bolt of the wheel from loosening. By utilizing this construction, an assembly and a detachment of the wheel assembly are easier and quicker to carry out.

5 Claims, 5 Drawing Sheets

DETACHABLE LUGGAGE WHEEL

BACKGROUND OF THE INVENTION

1. Field of the Invention

The present invention relates to a wheel assembly, and more particularly to a detachable luggage wheel in which the wheel can be detached from the exterior of the wheel assembly.

2. Description of Related Art

A typical detachable wheel assembly for a luggage as shown in FIG. 1 generally comprises a wheel E, an outer pedestal A, an inner pedestal B, and a number of screws C1 and C2. A pair of screws C1 are threadedly secured the inner pedestal B to the outer pedestal A from the interior of a luggage frame D. A pair of screws C2 are threadedly secured the outer pedestal A to the inner pedestal B from the exterior of the luggage frame D. In view of this, it is required to unfasten the screws C1 and C2 from the interior and the exterior respectively in order to replace them when the wheel E is worn-out and/or malfunctioned. To the worse, it is inevitable to dismantle the interior lining of the luggage in order to unfasten the screws C1. As a result, the interior lining is damaged and may not be recovered to its original form. It is deemed to be inconvenient.

Taiwanese Publication No. 262,663 (Application No. 83209412) and Publication No. 260,906 (Application No. 84203594) both disclose a detachable wheel assembly for a luggage. Their advantage is that it is simply required to detach an axis and a sleeve when replacing a wheel. Further, its plate is detachable. Further, the plate is threadedly secured to a hub from the interior of a luggage frame. Furthermore, when the wheel is malfunctioned, it is necessary to unfasten the screws from the interior of simplified detachment procedure.

Thus, it is desirable to provide a detachable wheel assembly for a luggage to overcome the above drawbacks of prior art.

SUMMARY OF THE INVENTION

It is an object of the present invention to provide a detachable wheel assembly for a luggage wherein the detachment of a wheel is achieved simply by pointing a pin member onto a resilient locking member of a recessed portion through a hole of a blocking member and exerting a force inwardly for releasing a blocking member from a pedestal, and then by pulling a bolt from the wheel assembly.

The advantages of the present invention are realized by providing a detachable wheel assembly for a luggage which comprises a pedestal, a wheel located on a lower part of the pedestal, a recessed portion provided on a side of the pedestal adjacent to a hub of the wheel, and a blocking member complementary in a shape to the recessed portion for being able to cling to a resilient locking member of the recessed portion for providing the fit setting of the blocking member onto the recessed portion, and preventing a bolt of the wheel from loosening.

The above and other objects, features and advantages of the present invention will become apparent from the following detailed description taken with the accompanying drawings.

DETAILED DESCRIPTION OF THE INVENTION

Figure 1:
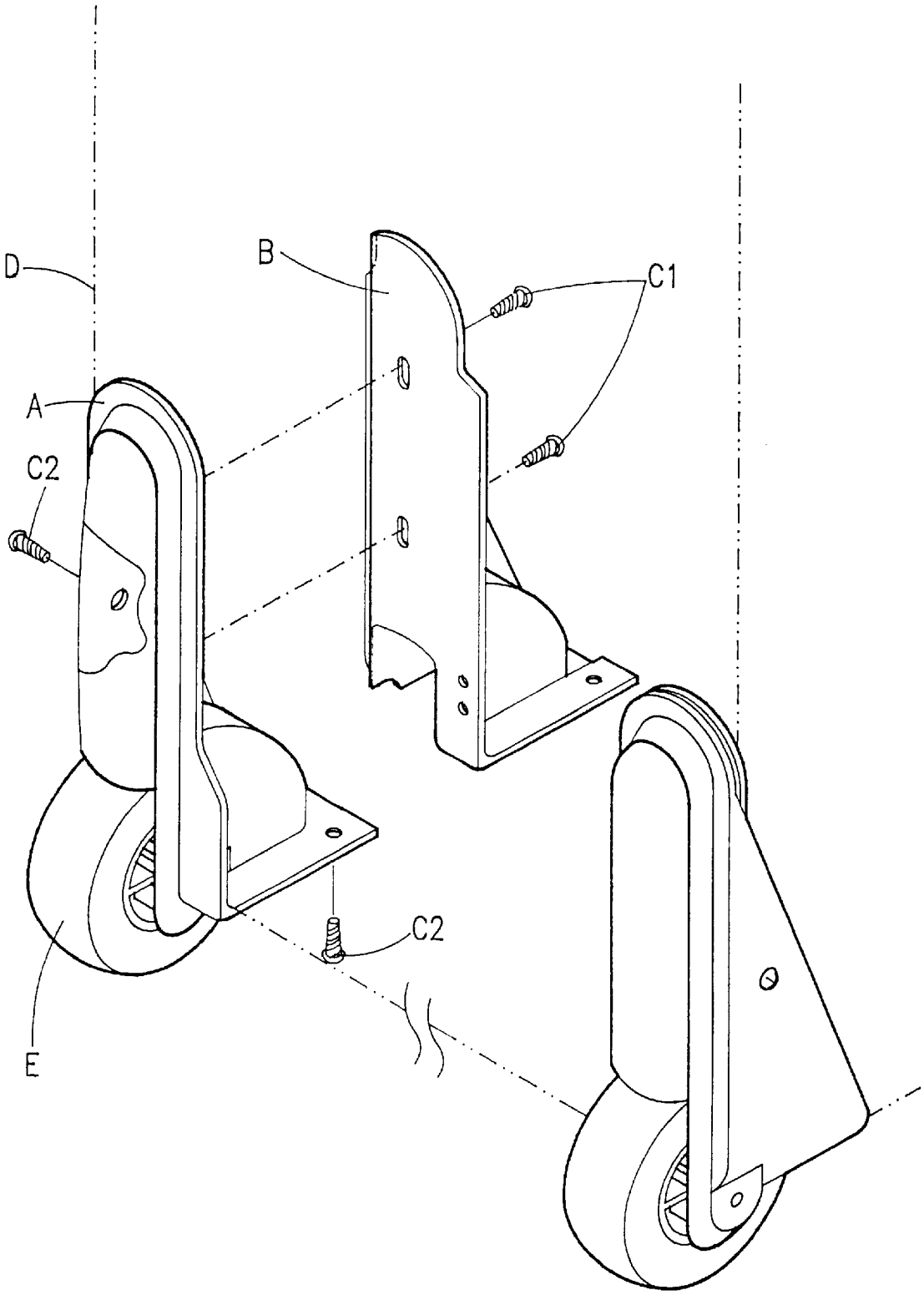
FIG. 1 (PRIOR ART)
FIG. 1 is a perspective view of a prior art detachable wheel assembly with screws separated from the wheel assembly.
Figure 2:
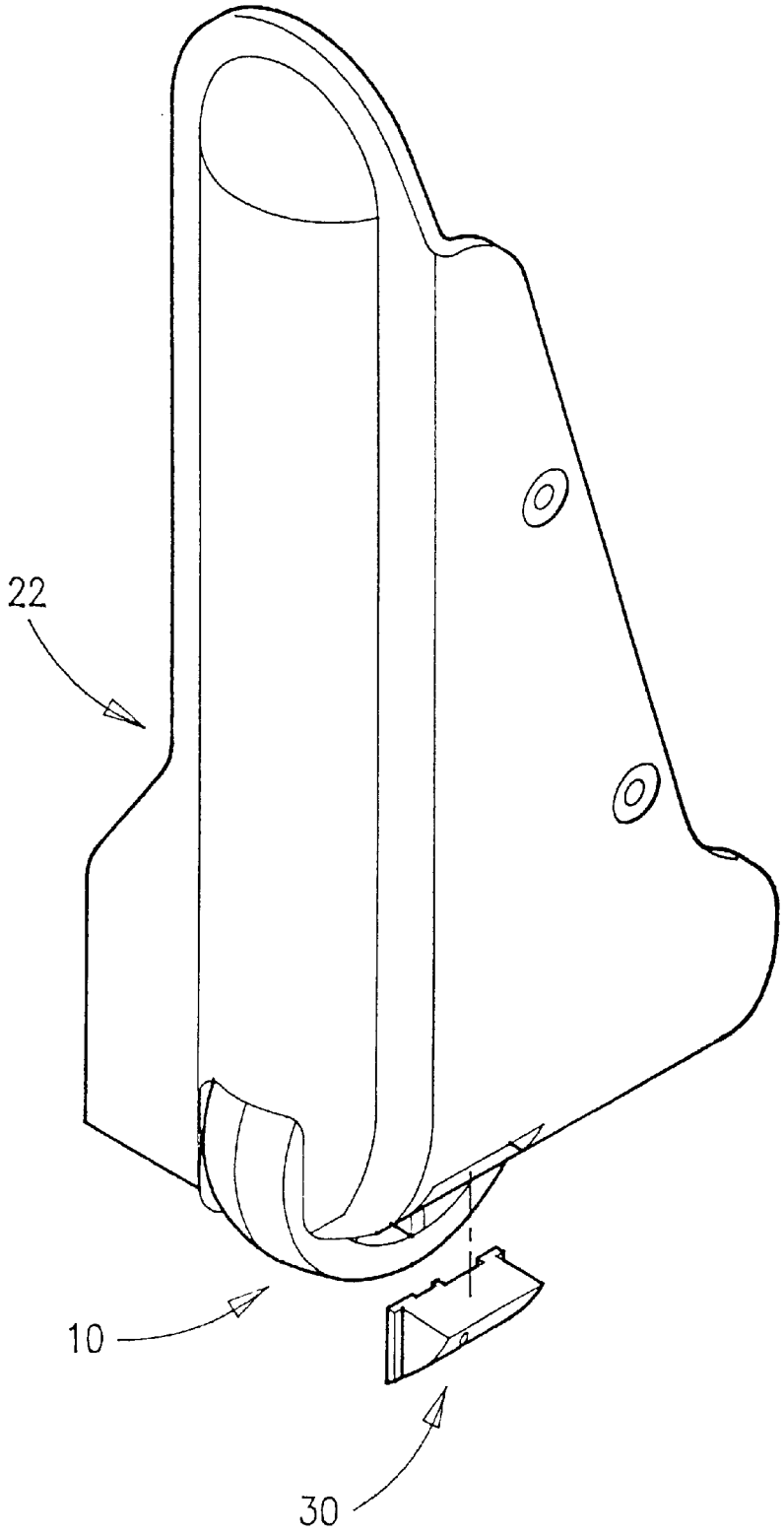
FIG. 2 is a perspective view of a wheel assembly of the present invention with a blocking member separated from the wheel assembly.
Figure 3:
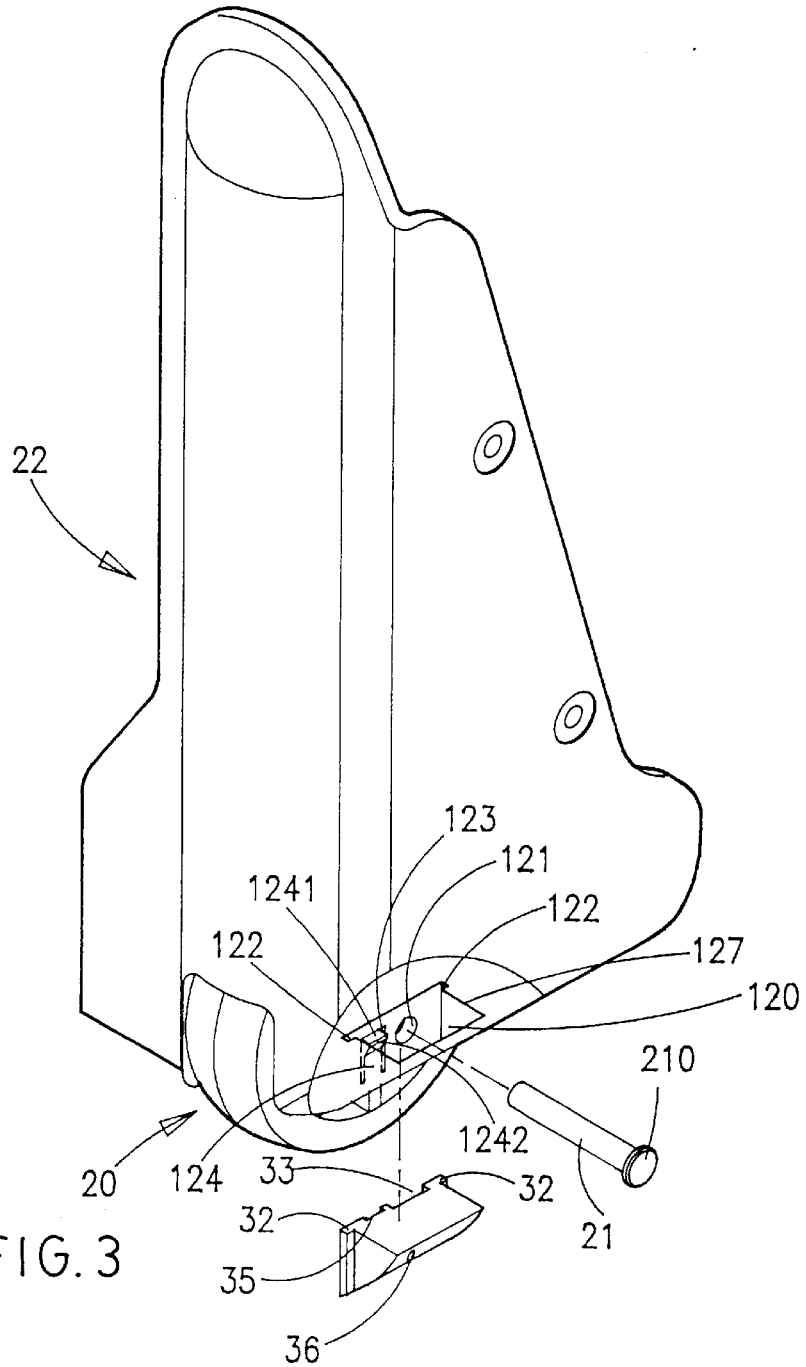
FIG. 3 is a more detailed perspective view of FIG. 2 with the blocking member and an axis separated from the wheel assembly.
Figure 4:
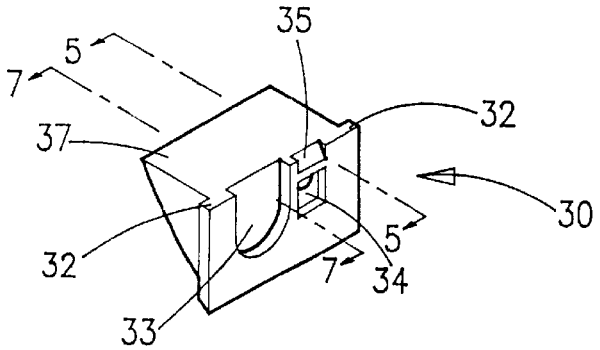
FIG. 4 is a perspective view of the blocking member of FIG. 2 for showing the other side thereof.
Figure 5:
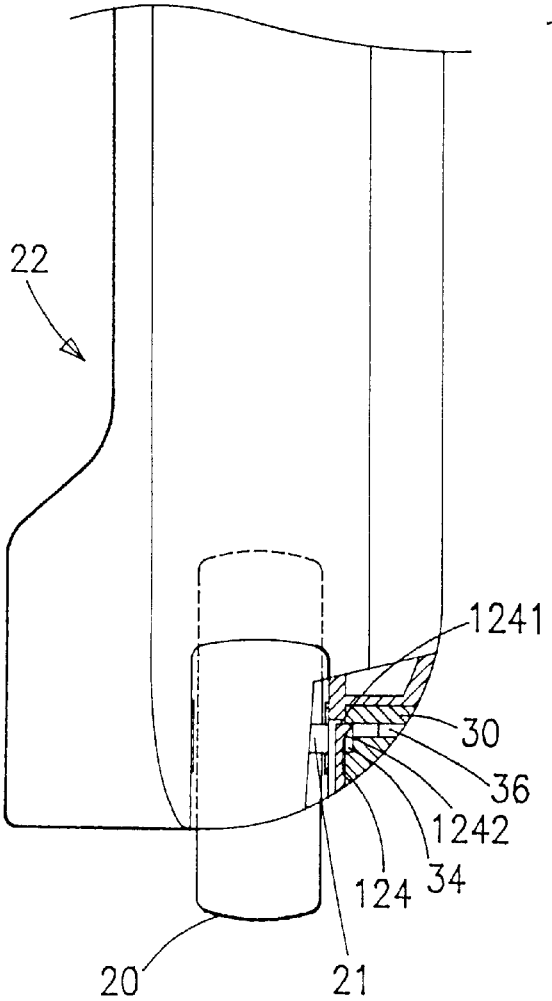
FIG. 5 is a front view of the wheel assembly in part sectional view taken along the line 5—5 of the FIG. 4 for showing the engagement of the blocking member to a recessed portion of a pedestal.
Figure 7:
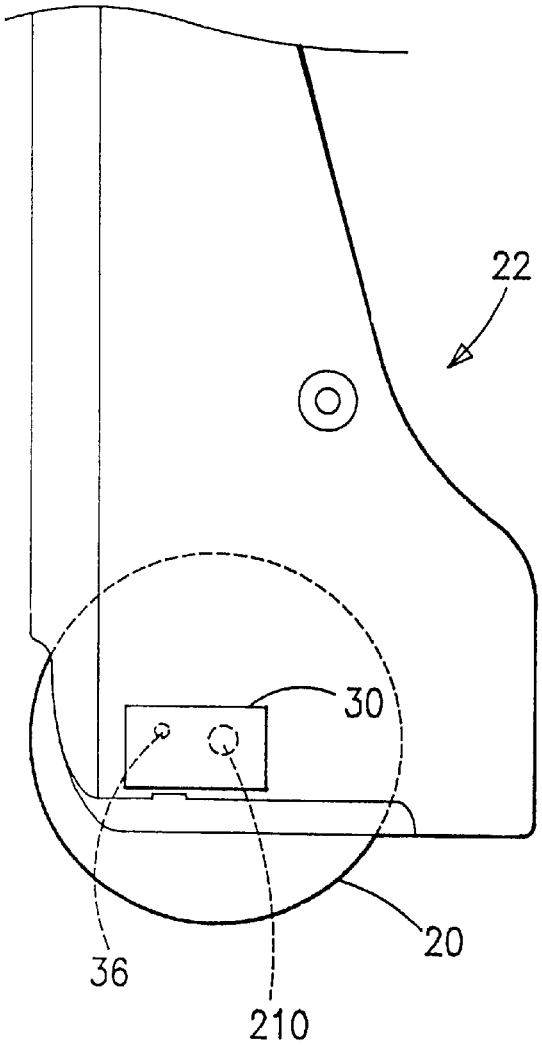
FIG. 7 is a side view of the wheel assembly of the present invention.
Figure 6:
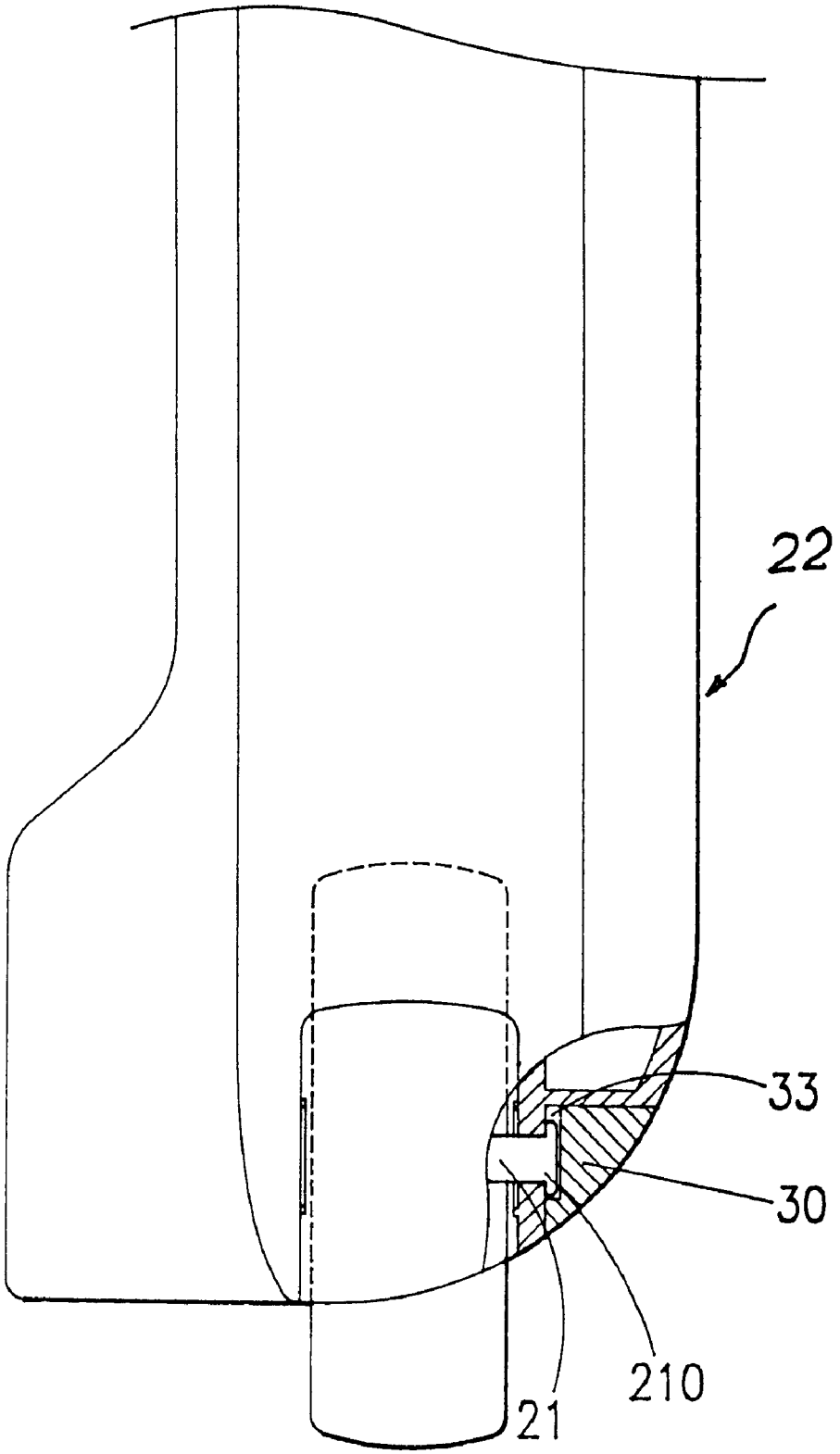
FIG. 6 is a front view of the wheel assembly in part sectional view taken along the line 6—6 of the FIG. 4 for showing the engagement of the blocking member to the recessed portion of the pedestal.

In FIGS. 2–7, a wheel assembly is shown. The wheel assembly 10 includes a pedestal 22, and a wheel 20 located on a lower part of the pedestal 22. A recessed portion 120 is provided on an outer surface of the pedestal 22 adjacent to a hub (not shown) of the wheel 20. A top of the recessed portion 120 is bordered on a planar surface 127. The recessed portion 120 and the planar surface 127 are perpendicular each other. The planar surface 127 is bounded between the recessed portion 120 and the outer surface of the pedestal 22 and by a predetermined distance separated from an inner surface (not shown) of the pedestal 22. The recessed portion 120 includes a through hole 121, a pair of guiding slots 122—122 each provided on a vertical side of the recessed portion 120, and a resilient locking member 124 positioned laterally adjacent to and by a predetermined distance from the through hole 121. The resilient locking member 124 has a fixed end formed on the pedestal 22, an opposite free end having a planar surface 1241 provided thereon, and an inclined surface 1242 positioned between the fixed end and the free end.

A blocking member 30 (referring specifically to FIGS. 2–3), complementary in a shape to the recessed portion 120, including a top surface 37 corresponding the planar surface 127 of the recessed portion 120, a pair of protrusions 32 each provided on a vertical side of the blocking member 30, a first recessed portion 33 generally having a half circumferential peripheral surface extended downwardly from the top surface 37, a second recessed portion 34 having a rectangular peripheral surface adjacent to the first recessed portion 33, an inclined surface 35 extended downwardly from the top surface 37 to a position above the second recessed portion 34, and a hole 36 through the bottom of the second recessed portion 34 and the outer surface of the blocking member 30.

The assembly of the wheel assembly 10 is detailed below:

First, insert a bolt 21 through the hole 121 for engaging the pedestal 22 to the wheel 20, and then urge the blocking member 30 to cling to the recessed portion 120 in which each of the protrusions 32—32 is upwardly inserted into a corresponding guiding slot 122—122, the inclined surface 1242 allows the blocking member 30 to move upwardly such that the resilient member 124 is pressed inwardly until the planar surface 1241 and the inclined surface 1242 are received within the second recessed portion 34, and the top surface 37 is engaged with the planar surface 127, thus providing the fit setting of the blocking member 30 onto the recessed portion 120, while a head 210 of the bolt 21 is received within the first recessed portion 33.

When the assembly is finished, the blocking member 30 is integral with the pedestal 22. In other words, the blocking member 30 is similar to a part cut away from the pedestal 22.

As to the detachment of the wheel 20, it is simply required to point a pin member (not shown) onto the inclined surface 1242 of the resilient locking member 124 through the hole 36 of the blocking member 30 and to exert a force inwardly for releasing the blocking member 30 from the recessed portion 120 by a downwardly pulling movement, and then to pull the bolt 21 from the wheel 20 and the pedestal 22.

In an alternative embodiment, the resilient locking member 124 may be provided on the blocking member 30, and the second recessed portion 34 may also be provided on the recessed portion 120.

While the invention herein disclosed has been described by means of specific embodiments, numerous modifications and variations could be made thereto by those skilled in the art without departing from the scope of the invention set forth in the claims.

What is claimed is:

1. A detachable wheel assembly for a luggage comprising:

a pedestal having a recessed portion provided on an outer surface thereof including a through hole, a pair of guiding slots each provided on a vertical side of the recessed portion, and a resilient locking member;

a blocking member, complementary in a shape to the recessed portion, having a top surface, a pair of protrusions each provided on a vertical side thereof, a first recessed portion, a second recessed portion, and a hole through the bottom of the second recessed portion and an outer surface of the blocking member; and a wheel located on a lower part of the pedestal;

wherein each of the pair of protrusions of said blocking member is inserted into the corresponding pair of guiding slots of said recessed portion when the blocking member is clung to the recessed portion, the resilient locking member will allow the blocking member to move upwardly such that the resilient locking member is pressed inwardly until the resilient locking member is received within the second recessed portion.

2. The detachable wheel assembly as claimed in claim 1, wherein said resilient locking member further comprises a fixed end formed on the pedestal, an opposite free end, and an inclined surface positioned between the fixed end and the free end.

3. The detachable wheel assembly as claimed in claim 2, wherein an inner end of the hole of the blocking member is adjacent to the free end of the resilient locking member.

4. The detachable wheel assembly as claimed in claim 1, wherein said blocking member further comprises an inclined surface located between the top surface and the second recessed portion.

5. The detachable wheel assembly as claimed in claim 1, wherein a bolt having a head and attaching the wheel to the pedestal is received within the first recessed portion.

* * * * *